US012202582B2

(12) United States Patent
McCune et al.

(10) Patent No.: US 12,202,582 B2
(45) Date of Patent: Jan. 21, 2025

(54) LOCATION INDICATOR ASSEMBLY AND FLOTATION DEVICE EQUIPPED WITH LOCATION INDICATOR ASSEMBLY

(71) Applicant: INTEGRATED DESIGN SOLUTIONS LLC, Dix Hills, NY (US)

(72) Inventors: Edward T. McCune, Dix Hills, NY (US); Jerry Raio, Dix Hills, NY (US); Reid W. Kelly, Lake Forest, IL (US); Thomas F. Sweeney, Lake Forest, IL (US)

(73) Assignee: INTEGRATED DESIGN SOLUTIONS LLC

( * ) Notice: Subject to any disclaimer, the term of this patent is extended or adjusted under 35 U.S.C. 154(b) by 455 days.

(21) Appl. No.: 17/831,505

(22) Filed: Jun. 3, 2022

(65) Prior Publication Data

US 2022/0388615 A1 Dec. 8, 2022

Related U.S. Application Data

(60) Provisional application No. 63/197,200, filed on Jun. 4, 2021.

(51) Int. Cl.
*B63C 9/20* (2006.01)
*B63C 9/11* (2006.01)

(52) U.S. Cl.
CPC . *B63C 9/20* (2013.01); *B63C 9/11* (2013.01)

(58) Field of Classification Search
CPC ..... B63C 9/11; B63C 9/20; B63B 22/16
USPC ..... 441/89, 6; 116/173
See application file for complete search history.

(56) References Cited

U.S. PATENT DOCUMENTS

| | | | | |
|---|---|---|---|---|
| 7,013,823 | B1 * | 3/2006 | Daugherty | B63B 45/00 114/252 |
| 10,286,987 | B2 * | 5/2019 | Duff | B63C 9/20 |
| 10,562,601 | B2 * | 2/2020 | McLaughlin | B63C 9/08 |
| 2011/0092117 | A1 * | 4/2011 | Delgado | B63C 9/20 441/89 |
| 2011/0097952 | A1 * | 4/2011 | Pirie | B63C 9/20 441/89 |

* cited by examiner

*Primary Examiner* — Daniel V Venne
(74) *Attorney, Agent, or Firm* — DP IP GROUP; Franco S. De Liguori

(57) ABSTRACT

A location indicator assembly has a support mechanism for undergoing movement between a retracted position and a deployed position, an indicator device mounted to the support mechanism, and a mechanism for deploying and retracting the support mechanism to place the indicator device between deployed and retracted states, respectively. A flotation device, such as a life jacket, is equipped with the location indicator assembly to provide high visibility for an individual floating in open water while using the flotation device.

17 Claims, 10 Drawing Sheets

LOCATION INDICATOR ASSEMBLY AND FLOTATION DEVICE EQUIPPED WITH LOCATION INDICATOR ASSEMBLY

RELATED APPLICATION

This application claims the benefit of U.S. Provisional Patent Application No. 63/197,200, filed on Jun. 4, 2021.

BACKGROUND

Technical Field

The present invention relates generally to water safety devices, and more particularly to a location indicator assembly and to a flotation device, such as a life jacket, equipped with the location indicator assembly.

Background Information

Water safety devices include flotation devices, such as life vests, life jackets, flotation rings, etc. Such water safety devices are required for individuals on boats, ships and even aircraft in case of an emergency resulting in an individual being thrown into the water. Life vests are integral life saving devices to prevent drowning. The mandated bright orange color of the life vest provides an aid for search and rescue responders to visually identify individuals floating in open water. However, since a significant portion of a life vest would be submerged when worn, very little of the orange color may be visible from a distance, especially in rough water conditions.

Moreover, while flotation devices may reduce drowning risks, many waterborne activities carry other risks as well. Collisions between watercraft, such as boats, personal watercraft, etc., poses a serious danger. Activities such as the use of personal watercraft, water skiing, etc., may often involve repeated entries into the water by participants. For example, while the water skier is making a run, most of the water skier's body is above the water, and the skier can be easily seen by watercraft operators. However, if the water skier falls, only their head and a portion of their torso may be above the water, making it difficult for watercraft operators to identify and avoid the water skier. Such poor visibility may lead to collisions between the watercraft and individuals in the water.

SUMMARY

In a first aspect, the present invention provides a location indicator assembly providing high visibility for an individual floating in open water.

In an embodiment, the location indicator assembly includes a support mechanism for undergoing movement between a retracted position and a deployed position, an indicator device mounted to the support mechanism, and means for deploying and retracting the support mechanism to place the indicator device between deployed and retracted states, respectively.

In exemplary embodiments, the support mechanism comprises a scissor link mechanism, and the indicator device comprises a pendant or flag.

The location indicator assembly further includes a housing structure on which the support mechanism is mounted for undergoing movement between the retracted and deployed positions. The housing structure has guide slot, an anchor pin, a base pin, and a pivot pin. The support mechanism comprises a plurality of links including a pair of upper links to which the indicator device is connected and a pair of lower links. One of the lower links is connected to the base pin of the housing structure for undergoing pivotal movement relative thereto, and the other of the lower links has a sliding pin for undergoing sliding movement within the guide slot of the housing structure.

According to an embodiment of the present invention, the means for deploying and retracting the support mechanism includes a latch member, first and second biasing members, and a second biasing member, and deployment and retraction cable assemblies. The latch member is mounted to the pivot pin of the housing structure for undergoing movement between an unpivoted position and a pivoted position to latch and unlatch the sliding pin. The first biasing member biases the latch member to the unpivoted position. The deployment cable assembly is connected to the latch member for applying a pulling force to pivot the latch member to the pivoted position against a biasing force of the first biasing member. The second biasing member interconnects the sliding pin to the anchor pin of the housing structure. The retraction cable assembly is connected to the sliding pin for applying a pulling force to slide the sliding pin along the guide slot of the housing structure against a biasing force of the second biasing member.

According to a feature of the present invention, in the retracted position of the support mechanism in which the indicator device is in a retracted state, the sliding pin is retained by the latch member against the bias of the second biasing member. Upon application of a pulling force by the deployment cable assembly, the latch member is pivoted about the pivot pin and against the biasing force of the first biasing member to unlatch the sliding pin so that sliding pin is permitted to undergo sliding movement along the guide slot to cause the support mechanism to undergo movement to the achieve the deployed position in which the indicator device is in the deployed state.

According to another feature of the present invention, in the deployed state of the indicator device, upon application of a pulling force by the retraction cable assembly, the sliding pin is caused to slide towards the latch member against the biasing force of the second biasing member until the sliding pin is latched by the latch member to place the support mechanism in the retracted position in which the indicator device is in the retracted state.

In a second aspect, the present invention is directed to a flotation device equipped with the location indicator assembly of the present invention. In one embodiment, the flotation device is a life jacket.

In an embodiment of the present invention according to the second aspect, the life jacket comprises a vest and the cable assemblies and corresponding pull handles of the location indicator assembly are mounted relative to the vest such that the pull handles are positioned in a waist region of the vest so as to be readily accessible by the user's hands for deploying and retracting the support mechanism to place the indicator device between deployed and retracted states. In an alternative embodiment, the cable assemblies and corresponding pull handles of the location indicator assembly are mounted relative to the vest such that the pull handles are positioned in a neck and/or chest region of the vest so as to be readily accessible by the user's hands for deploying and retracting the support mechanism to place the indicator device between deployed and retracted states.

These and other aspects, features and advantages of the present invention will become apparent from the following detailed description of illustrative embodiments thereof, which is to be read in connection with the accompanying drawings.

BRIEF DESCRIPTION OF DRAWINGS

The disclosure will provide details in the following description of preferred embodiments of the invention with reference to the following figures wherein.

DETAILED DESCRIPTION OF PREFERRED EMBODIMENTS

Embodiments of the present invention provide high visibility for an individual floating in open water by providing a wearable flotation device, such as a life jacket, equipped with a location indicator assembly having an indicator device that can be readily deployed by the individual wearing the flotation device. Moreover, when not in use the indicator device can be readily retracted by the individual so that it does not interfere with activities of the individual while wearing the flotation device.

Figure 2:
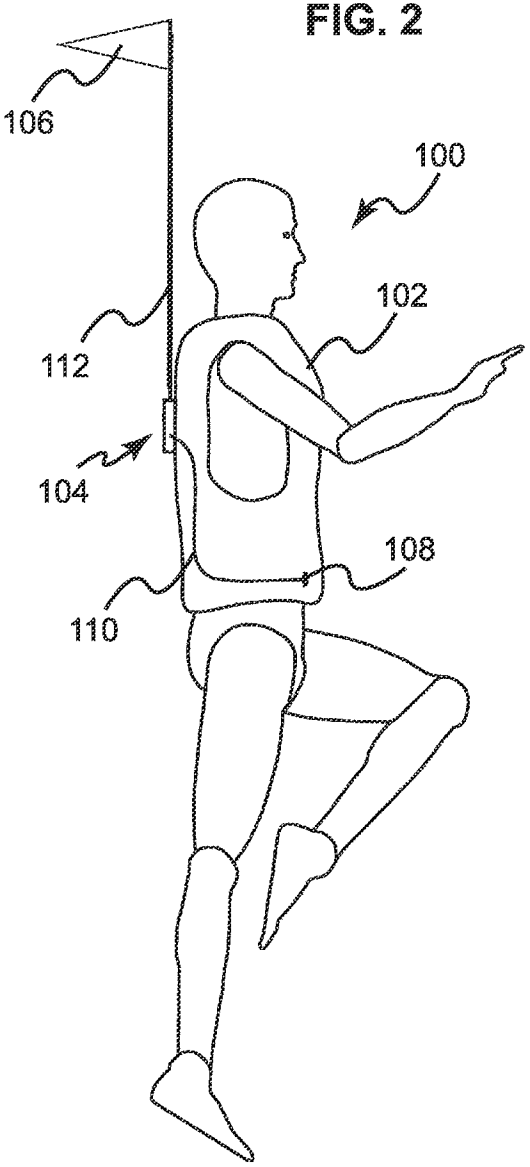
FIG. 2 is a side view similar to FIG. 1 showing the indicator device in a deployed state, in accordance with an embodiment of the present invention.
Figure 1:
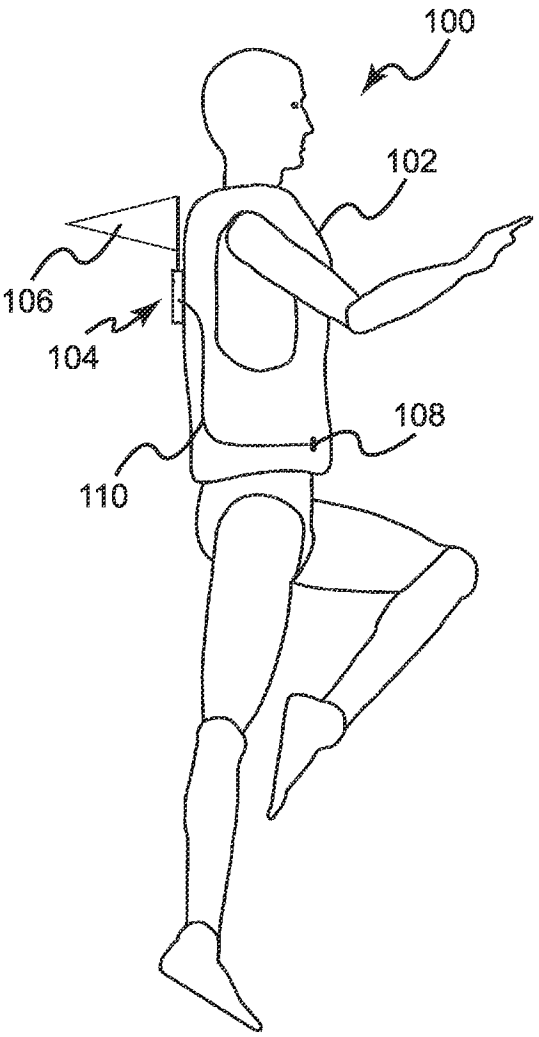
FIG. 1 is a side view of an individual with a wearable flotation device equipped with a location indicator assembly showing an indicator device in a retracted state, in accordance with an embodiment of the present invention.
Figure 4:
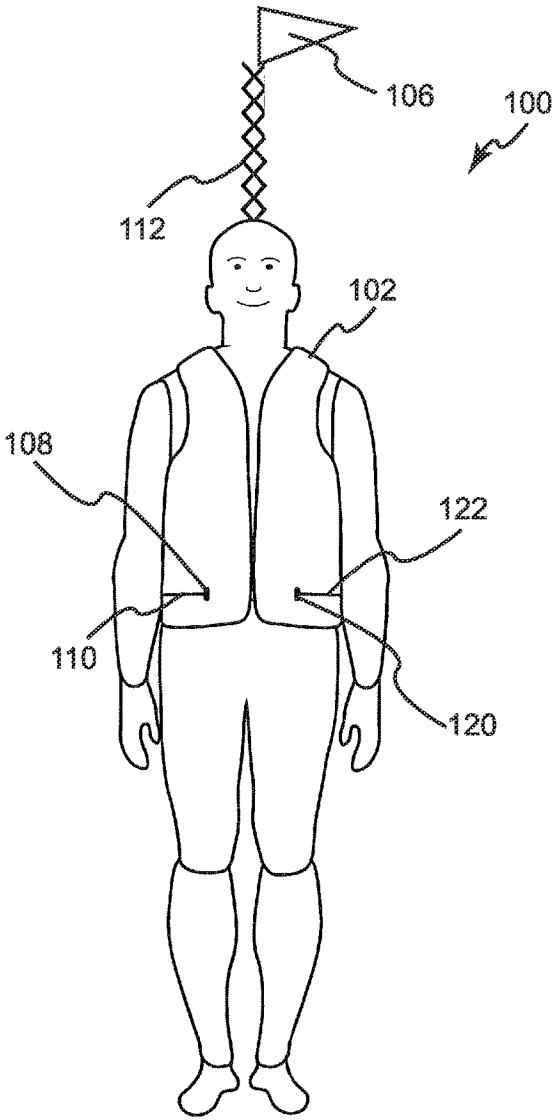
FIG. 4 is a frontal view of the individual shown in FIG. 2.
Figure 3:
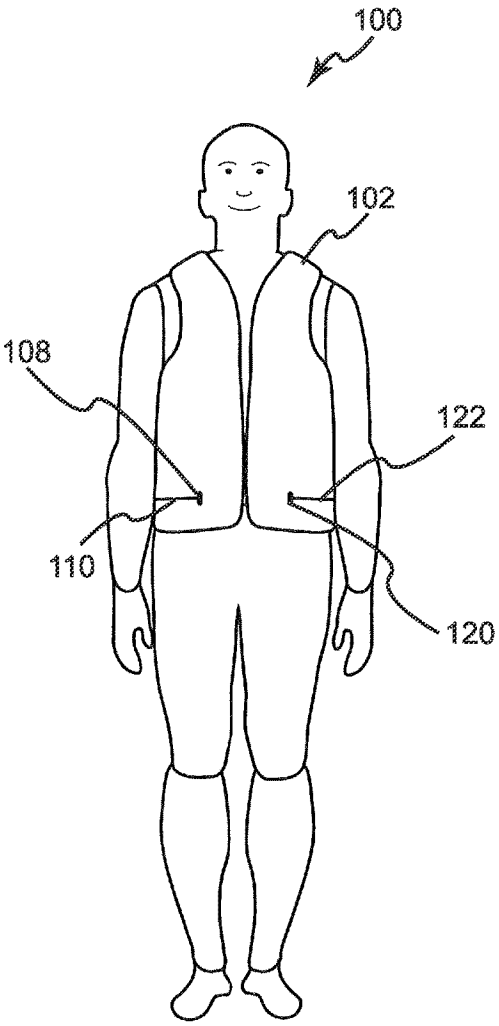
FIG. 3 is a frontal view of the individual shown in FIG. 1.
Figure 6:
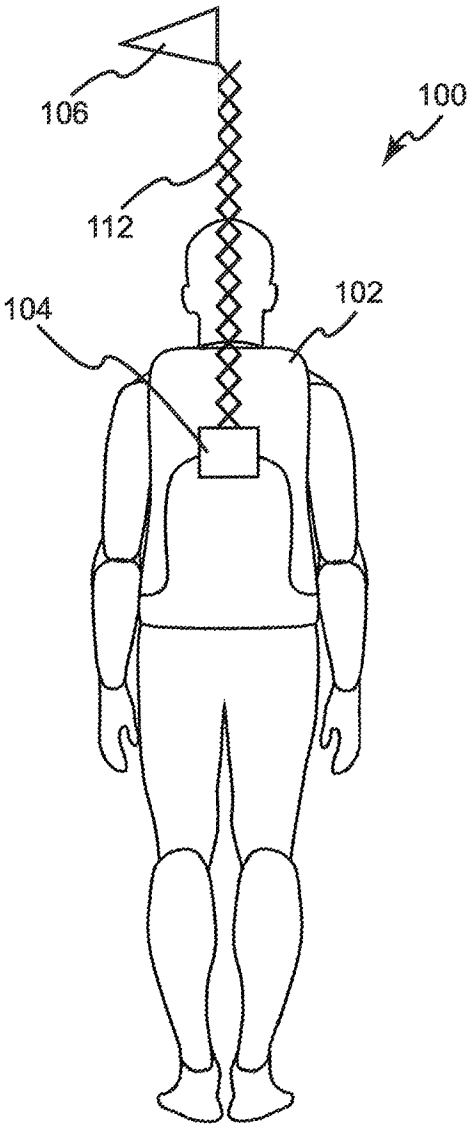
FIG. 6 is a rear view of the individual shown in FIG. 2.
Figure 5:
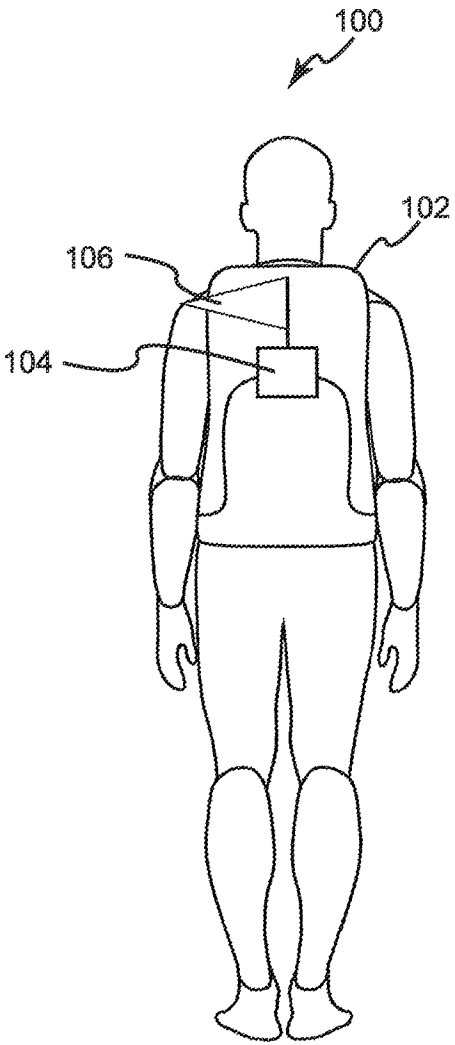
FIG. 5 is a rear view of the individual shown in FIG. 1.

Turning to FIGS. 1-6, an individual 100 is shown wearing a wearable flotation device, e.g., life jacket, 102 equipped with a location indicator assembly 104, according to an embodiment of the present invention. Location indicator assembly 104 is configured to place an indicator device 106 as a marker between a retracted state, as shown in FIGS. 1, 3, 5, and a deployed (also referred to herein as "released") state, as shown in FIGS. 2, 4, 6. According to a feature of the present invention, the retracted and deployed states of indicator device 106 can be selectively carried out by direct actions of individual 100 wearing wearable flotation device 102 equipped with location indicator assembly 104.

The structural configuration of location indicator assembly 104 according to an embodiment of the present invention is described below with reference to the embodiment show in FIGS. 7-14.

Location indicator assembly 104 includes a housing structure 4 with first and second opposite sides 4*a*, 4*b*, a support mechanism 112 mounted at a first end thereof to first side 4*a* of housing structure 4 for undergoing movement between a retracted position (FIGS. 7-9) and a deployed position (FIGS. 10-12), indicator device 104 mounted at a second end of support mechanism 112 opposite the first end, and a mechanism for deploying and retracting support mechanism 112 to place indicator device 106 between the deployed and retracted states, respectively.

In this embodiment, housing structure 4 is in the form a generally rectangular-shaped plate provided with a guide slot 7 extending from first side 4*a* to second side 4*b* and along the length of the rectangle (as shown in FIGS. 10-14), pivot pins 8, 20, and an anchor pin 10. In alternative embodiments, housing structure 4 can be configured in a form other than a generally rectangular-shaped rectangular plate.

Figure 10:
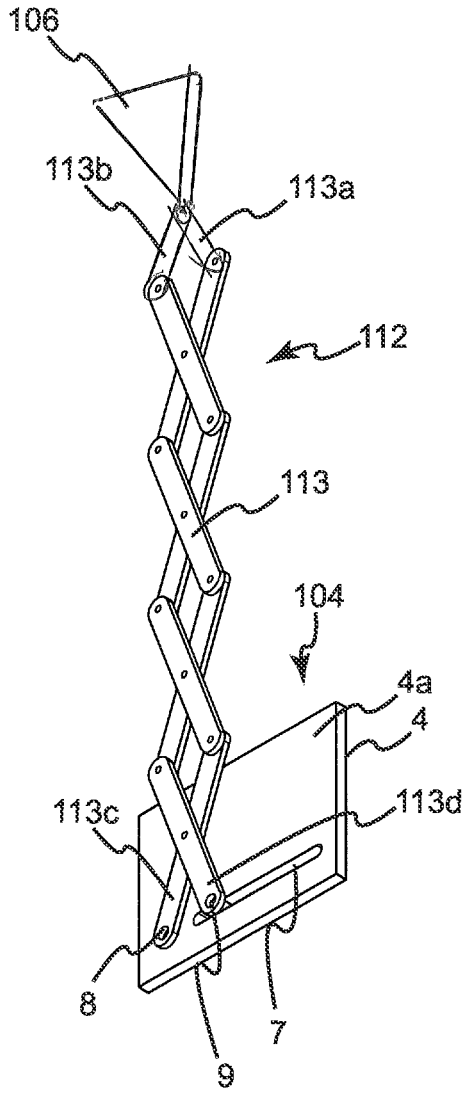
FIG. 10 is a perspective view showing the support mechanism of the location indicator assembly in a deployed state, in accordance with an embodiment of the present invention.
Figure 11:
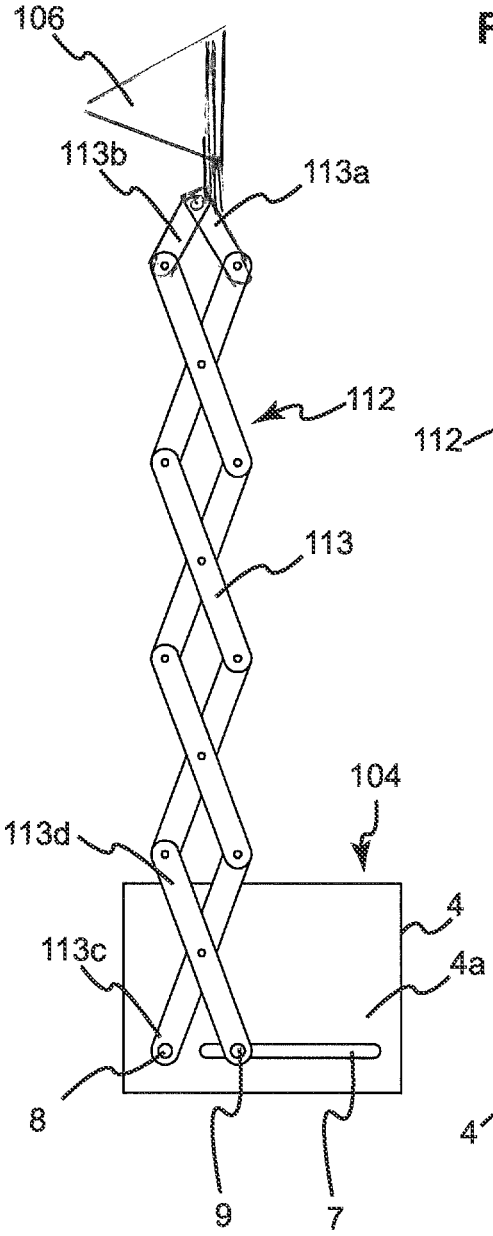
FIG. 11 is a frontal view showing the support mechanism of the location indicator assembly in the deployed state.
Figure 12:
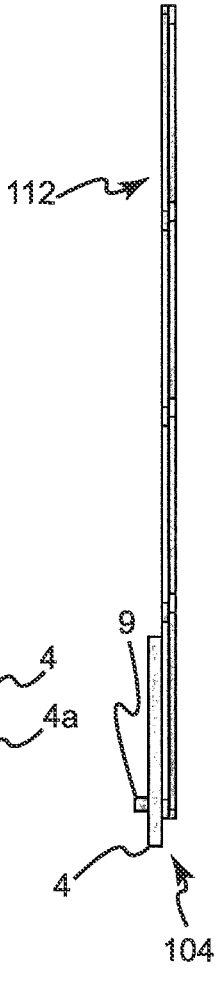
FIG. 12 is a side view showing the support mechanism of the location indicator assembly in the deployed state.

Support mechanism 112 includes links 113 arranged in the form of a scissor link mechanism (FIGS. 6-8, 10-11). Indicator device 106 is securely mounted to a connection point 3 of upper links 113*a*, 113*b* of support mechanism 112. Lower links 113*c*, 113*d* of support mechanism 112 are mounted to housing structure 4. Specifically, link 113*c* is mounted to pin 8 for undergoing pivotal movement relative to housing structure 4, and link 113*d* is mounted to a sliding pin 9 provided for undergoing sliding movement within guide slot 7 (FIGS. 10-11). By this configuration, support mechanism 112 is configured to undergo movement from the retracted position shown in FIGS. 7-8 to the deployed position shown in FIGS. 10-11 upon selective activation by individual 100 of the mechanism for deploying and retracting support mechanism 112 as further described below. While support mechanism 112 is embodied herein as a scissor link mechanism, it is understood that other structures may be used in place of the scissor link mechanism for the purpose of placing indicator device 106 between the deployed and retracted states.

Figure 13:
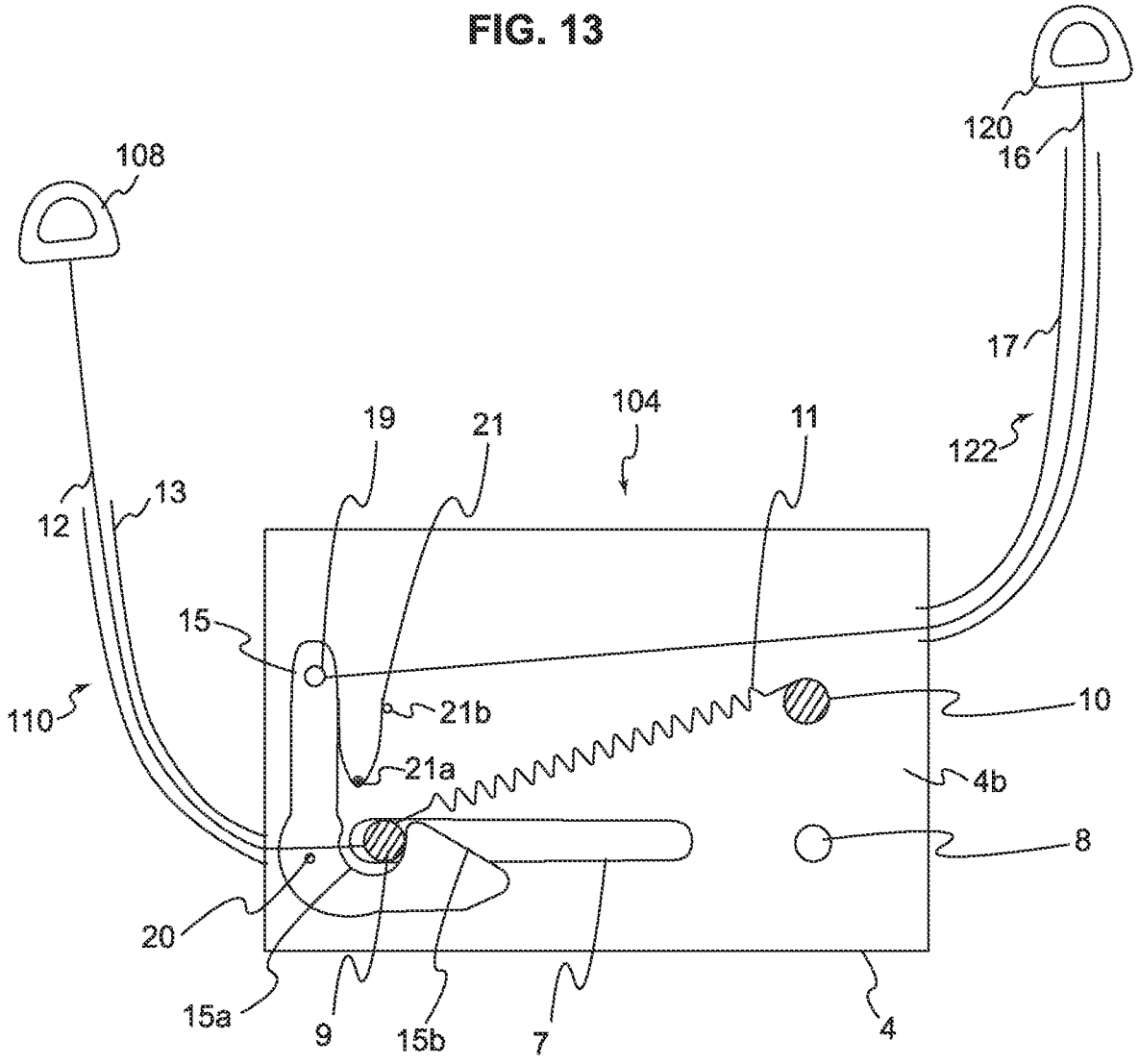
FIG. 13 is a diagrammatic view of the location indicator assembly when the support mechanism is in the retracted state, in accordance with an embodiment of the present invention.
Figure 14:
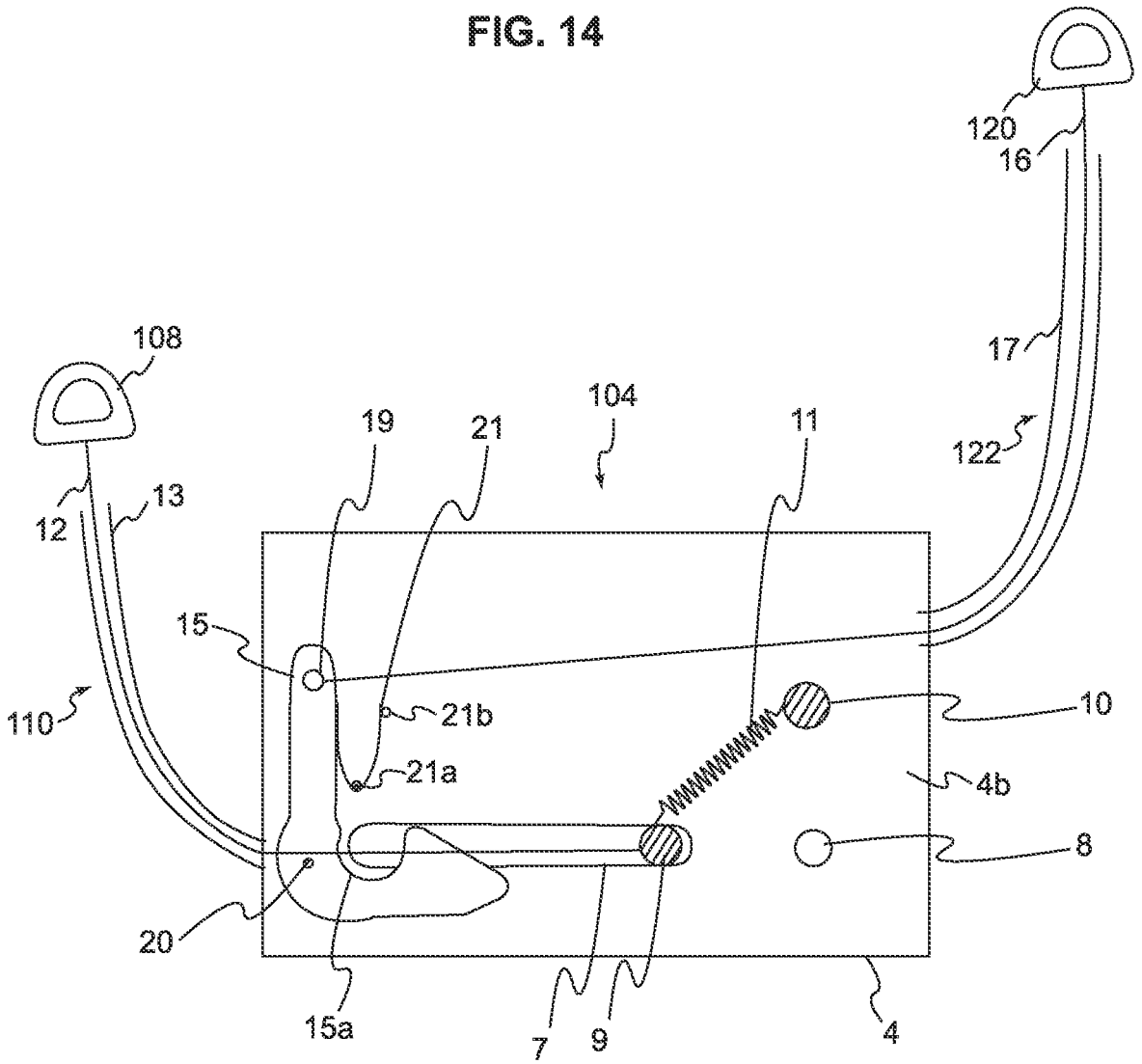
FIG. 14 is a diagrammatic view of the location indicator assembly when the support mechanism in the deployed state, in accordance with an embodiment of the present invention.
Figure 16:
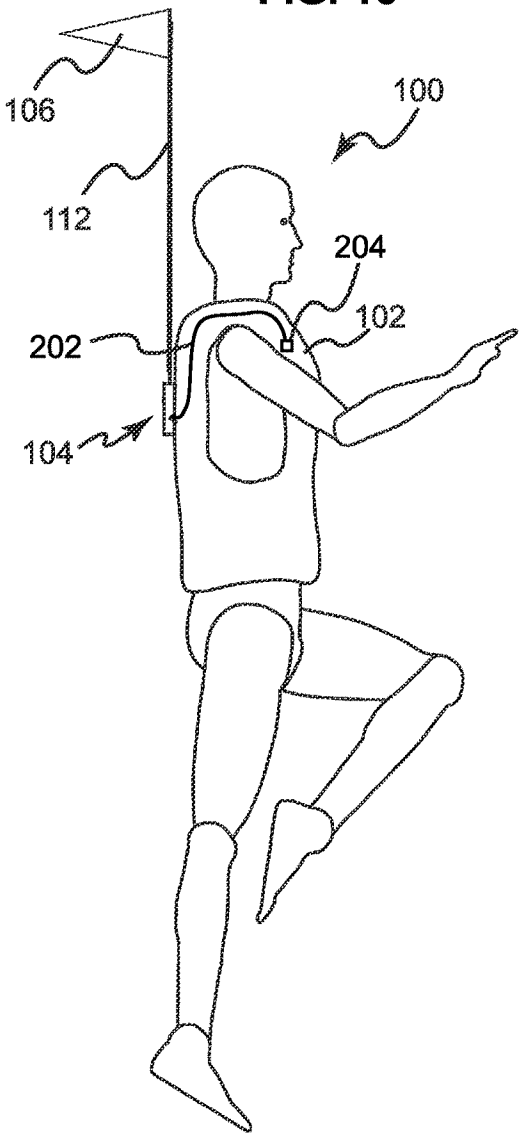
FIG. 16 is a side view similar to FIG. 15 showing the indicator device in a deployed state, in accordance with an embodiment of the present invention.
Figure 15:
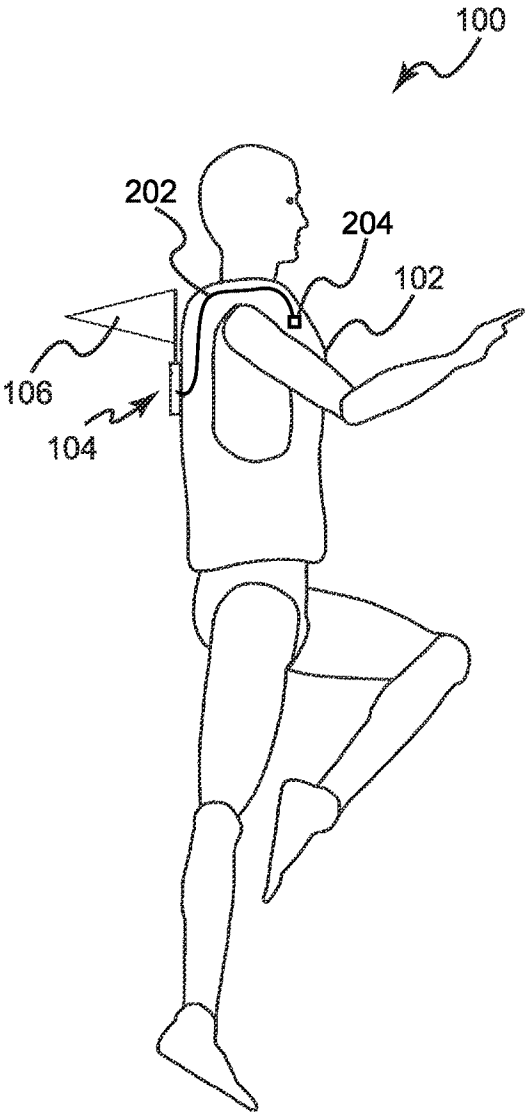
FIG. 15 is a side view of an individual with a wearable flotation device equipped with a location indicator assembly showing an indicator device in a retracted state, in accordance with another embodiment of the present invention.
Figure 18:
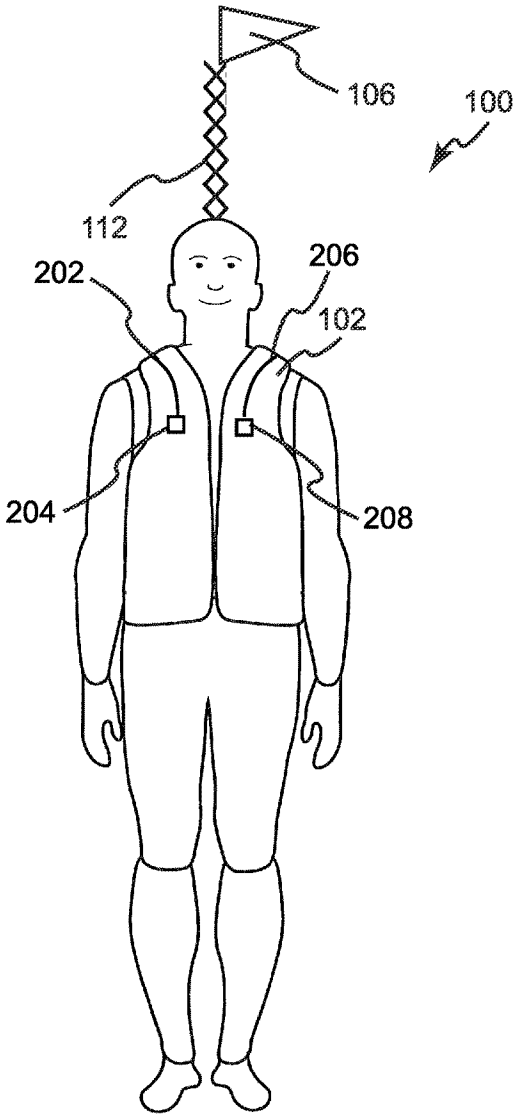
FIG. 18 is a frontal view of the individual shown in FIG. 16.
Figure 17:
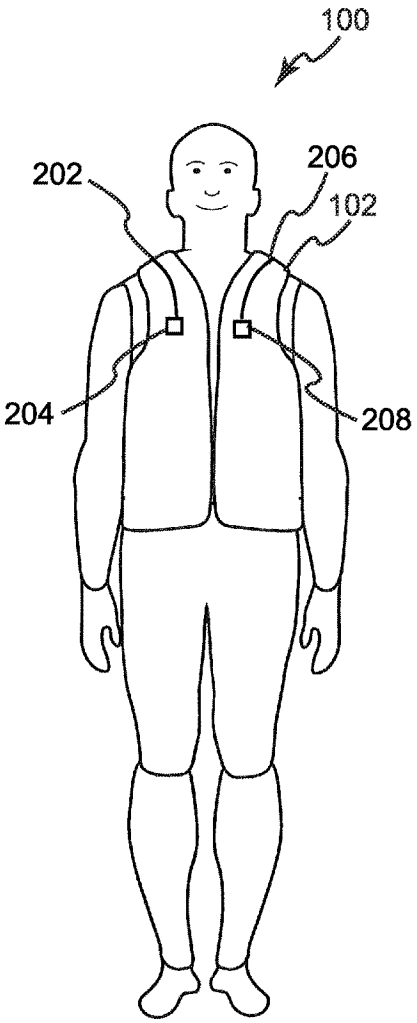
FIG. 17 is a frontal view of the individual shown in FIG. 15.
Figure 20:
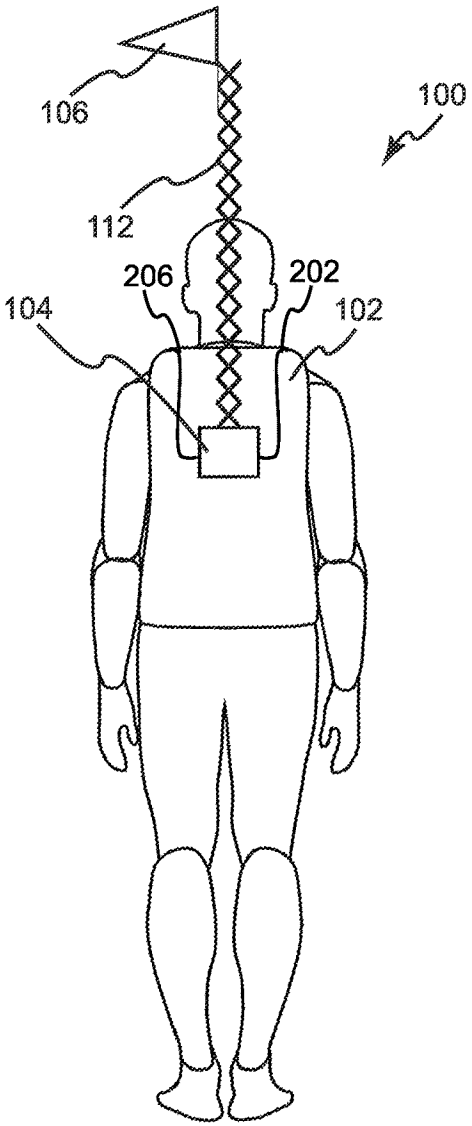
FIG. 20 is a rear view of the individual shown in FIG. 16.
Figure 19:
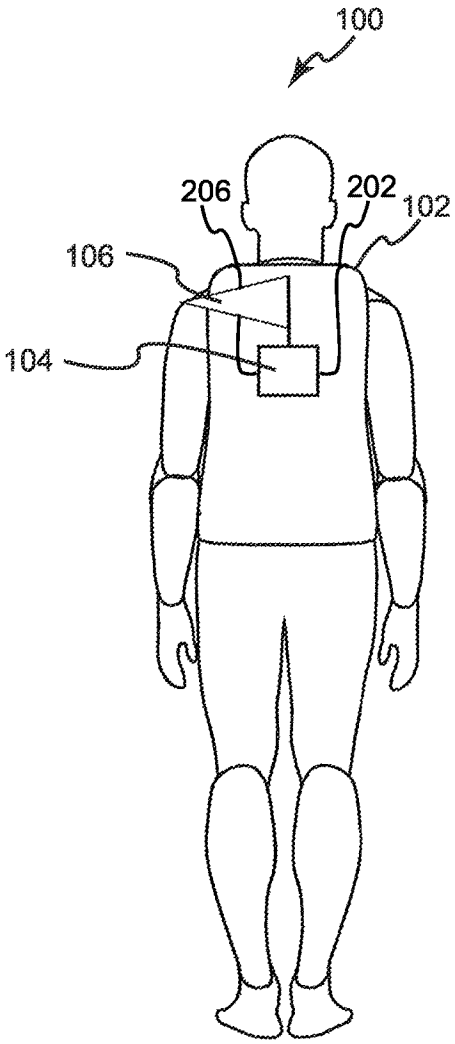
FIG. 19 is a rear view of the individual shown in FIG. 15.

FIGS. 13 and 14 illustrate the mechanism for deploying and retracting support mechanism 112, where FIG. 13 shows the configuration of location indicator assembly 104 when support mechanism 112 is in the retracted position shown in FIGS. 1, 3, 5 and 7-9, and FIG. 14 shows the configuration of location indicator assembly 104 when support mechanism 112 is in the deployed position shown in FIGS. 2, 4, 6 and 10-12.

The mechanism for deploying and retracting support mechanism 112 includes a latch member 15, a retraction cable assembly 110, and a deployment cable assembly 122. Latch member 15 is mounted to pivot pin 20 on the second side 4*b* of housing structure 4 for undergoing pivotal movement relative thereto. A first biasing member (e.g., leaf spring) 21 is mounted to second side 4*b* of housing structure 4 at support points 21*a*, 21*b* for biasing latch member 15 to the position shown in FIGS. 13-14, that is, for biasing latch member 15 in the counterclockwise direction about pivot pin 20. As shown in FIG. 13, latch member 15 has a retaining portion 15*a* configured to retain sliding pin 9 on a left side of guide slot 7 in the retracted position of support mechanism 112.

Deployment cable assembly 122 is connected at a terminal end thereof to an anchor point 19 of latch member 15. Retraction cable assembly 110 is connected at a terminal end thereof to sliding pin 9 associated with link 113*d* of support mechanism 112 as described above. A second biasing member (e.g., coil spring) 11 is connected at opposite ends thereof to sliding pin 9 and anchor pin 10 of housing structure 4 for biasing sliding pin 9 towards a right side of guide slot 7 as shown in FIG. 14.

In this embodiment, each of the retraction cable assembly 110 and deployment cable assembly 122 may be in the form of a BOWDEN® cable arrangement including an inner cable arranged to move relative to a hollow outer cable housing. For example, retraction cable assembly 110 includes an inner retraction cable 12 configured to move relative to a hollow outer cable housing 13 and having the terminal end connected to sliding pin 9 as described above. Deployment cable assembly 122 includes an inner deployment cable 16 configured to move relative to a hollow outer cable housing 17 and having the terminal end connected to anchor point 19 of latch member 15 as described above. At an end opposite its terminal end, cable 16 is attached to a deployment or release pull handle 120 accessible to and configured to be handled by individual 100 to pull cable 16 outwardly from the individual's body to deploy support mechanism 112 and place indicator device 106 in the deployed or released state (FIGS. 2, 4, 6, 10-12, 14). At an end opposite its terminal end, cable 12 is attached to a retraction pull handle 108 accessible to and configured to be handled by individual 100 to pull cable 12 outwardly from the individual's body to retract support mechanism 112 and place indicator device 106 in the retracted state (FIGS. 1-5, 7-9, 13). In this embodiment, each of retraction pull handle 108 and release pull handle 120 has a generally D-shaped configuration to facilitate handling by individual 100 during pulling of cables 12 and 16, respectively. It is understood, however, that handles 108 and 122 can be configured in any suitable shape provided that the selected configuration permits individual 100 to be able to readily access the handles, particularly during deployment of indicator device 106.

Location indicator assembly 104 may be removably coupled to flotation device 102 or may be an integral component of flotation device 102. In the present embodiment, flotation device 102 is in the form of a life jacket in the form of a vest worn by individual 100 as shown in FIGS. 1-6. As best shown in FIGS. 1, 2, 5 and 6, location indicator assembly 104 can be removably mounted to an outside or exterior surface (e.g., rear surface) of life jacket 102. This embodiment allows location indicator assembly 104 to be retrofitted to existing life jackets without substantial (if any at all) modification to the life jackets. In an alternative embodiment, location indicator assembly 104 can be mounted in an interior surface of life jacket 102. For example, life jacket 102 may be formed with a compartment or pocket (not shown) dimensioned to receive and removably support location indicator assembly 104 so that support mechanism 112 can be deployed and retracted to place indicator device 106 in the deployed and retracted states as described above. In yet another embodiment, location indicator assembly 104 can be removably mounted to life jacket 102 with ties or hook and loop connectors (not shown) either on an outside surface of or within a compartment of life jacket 102. In yet another embodiment, the location indicator assembly 104 can be integrated into the life jacket 102 and thus non-removably held thereon.

In the embodiment shown in FIGS. 1-6 and 10-11, indicator device 106 is in the form of a pendant or flag. It is understood, however, that indicator device 106 may be configured in a form other than a pendant or flag and provided in any configuration and/or color so long as indicator device 106 is selected so as to be capable of improving visibility of the individual in the deployed state of indicator device 106 while wearing flotation device 102 equipped with location indicator assembly 104.

An embodiment of the operation of location indicator assembly 104 to deploy and retract indicator device 106 during use by individual 100 wearing flotation device 102 equipped with location indicator assembly 104 is described below with reference to the drawings.

Figure 7:
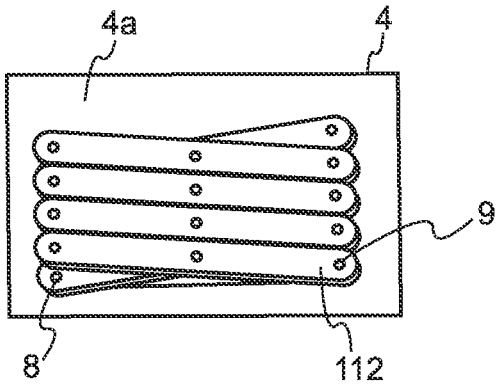
FIG. 7 is a frontal view showing a support mechanism of the location indicator assembly in a retracted position, in accordance with an embodiment of the present invention.
Figure 8:
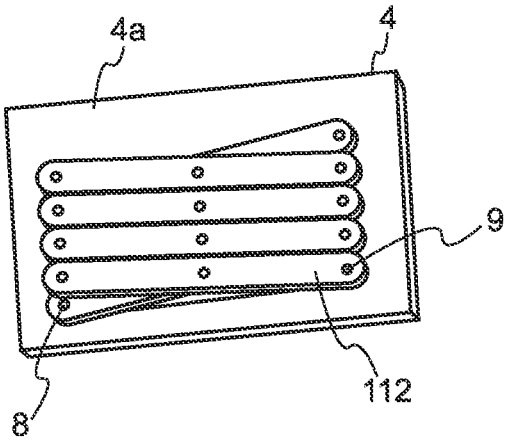
FIG. 8 is a perspective view showing the support mechanism of the location indicator assembly in the retracted position.
Figure 9:
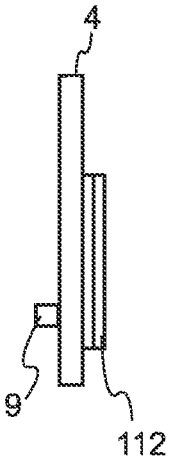
FIG. 9 is a side view showing the support mechanism of the location indicator assembly in the retracted position.

Prior to deployment of indicator device 106, flotation device 102 worn by individual 100 and equipped with location indicator assembly 104 is in the configuration shown in FIGS. 1, 3 and 5 in which indicator device 106 is in the retracted state. As shown in FIG. 13, in the retracted state of indicator device 106, latch member 15 is retained in the position shown under the bias of first biasing member 21 while sliding pin 9 is retained at a left side of guide slot 7 by retaining portion 15*a* of latch member 15 against the bias of second biasing member 11. Likewise, prior to deployment of indicator device 106, support mechanism 112 is in the retracted position as shown in FIGS. 7-9. It is noted that indicator device 106 has been omitted from FIGS. 7-9 only to facilitate understanding of the features of the present invention.

To initiate the deployment procedure, using the right or left hand the individual 100 pulls handle 120, and thus cable 16, away from the individual's body. Pulling of cable 16, which is attached to anchor point 19 of latch member 15, causes latch member 15 to pivot in a clockwise direction about pivot pin 20 until sliding pin 9 is caused to be released from retaining portion 15*a* of latch member 15 under the biasing action of second biasing member 11. Specifically, sliding pin 9 slides along guide slot 7 due to the action of second biasing member 11 until sliding pin 9 reaches the right side of guide slot 7 as shown in FIG. 14. Due to sliding pin 9 being attached to lower link 113*d* of support mechanism 112, support mechanism 112 undergoes vertical movement from the retracted position shown in FIGS. 7-9 to the deployed or released position shown in FIGS. 10-12. This results in deployment of indicator device 106 as shown in FIGS. 2, 4, 6 and 10-12, in which indicator device 106 is vertically extended on top of support mechanism 112.

Retraction of indicator device 106 is initiated from the configuration of location indicator assembly 104 shown in FIGS. 2-6, 10-12 and 14. To initiate the retraction procedure, using the right or left hand the individual 100 pulls handle 108, and thus cable 12, away from the individual's body. Pulling of cable 12, which is attached to sliding pin 9, causes sliding pin 9 to slide along and towards the left end of guide slot 7, against the bias of second biasing member 11, until sliding pin engages and rides on tapered surface portion 15*b* of latch member 15. As sliding pin 9 rides on tapered surface portion 15*b*, latch member 15 is caused to pivot in a clockwise direction about pivot pin 20 until sliding pin 9 engages retaining portion 15*a* of latch member 15 as shown in FIG. 13, at which point latch member 15 pivots in the counterclockwise direction under the biasing action of first biasing member 21. During movement of sliding pin 9 along guide slot 7 as described above, support mechanism 112 undergoes vertical movement from the deployed or released position shown in FIGS. 2-6 and 10-12 to the retracted position shown in FIGS. 1, 3, 5 and 7-9. This results in retraction of indicator device 106 as shown in FIGS. 1, 3, 5.

In the embodiment shown in FIGS. 1-6, pull handle 108 is positioned on the right side and pull handle 120 is positioned on the left side of flotation device 102 worn by individual 100. It is understood, however, that pull handles 108, 120 can be alternatively positioned on the left and right sides, respectively, of flotation device 102. As described above, individual 100 may utilize either the right or left hand to pull handles 108, 120, regardless of the position of pull handles on flotation device 102.

In the embodiment shown in FIGS. 1-6, the retraction and deployment cable assemblies 110, 122 and corresponding pull handles 108, 120 of location indicator assembly 104 are mounted relative to life jacket 102, which is in the form of a vest, such that the pull handles are positioned in a waist region of the vest so as to be readily accessible by the user's hands for deploying and retracting support mechanism 112 to place indicator device 106 between the deployed and retracted states as described above.

FIGS. 15-20 show an alternative embodiment in which the retraction and deployment cable assemblies of location indicator assembly 104 are denoted with reference numerals 202, 206, respectively, and the corresponding pull handles are denoted with reference numerals 204, 208, respectively. In this alternative embodiment, the cable assemblies 202, 206 and corresponding pull handles 204, 208 are mounted relative to the life jacket 102 (e.g., in the form of a vest) such that pull handles 204, 208 are positioned in a neck and/or chest region (instead of the waist region) of the vest so as to be readily accessible by the user's hands for deploying and retracting support mechanism 112 to place indicator device 106 between deployed and retracted states, as shown in FIGS. 15-20.

It will be appreciated from the foregoing description of the present invention according to the foregoing embodiments that in the deployed state, indicator device 106 provides high visibility for an individual floating in open water. Deployment of indicator device 106 can be readily achieved by a simple pulling action of pull handle 120, 208 by either the individual wearing flotation device 102 equipped with location indicator assembly 104 or by another individual in the proximity of the individual wearing flotation device 102. Likewise, retraction of indicator device 106 can be readily achieved by a simple pulling action of pull handle 108, 204 by either the individual wearing flotation device 102 or another individual in the proximity of the individual wearing flotation device 102. This permits retraction of indicator device 106 (and thus support mechanism 112) when location indicator assembly 104 is not in use so that support mechanism 112 and indicator device 106 do not interfere with activities of the individual while wearing flotation device 102. This ability to be able to readily deploy and retract indicator device 106 as needed (i.e., on demand) is a feature of the present invention.

The embodiments described herein disclose location indicator assembly 104 used in conjunction with flotation device 102 in the form of a life jacket. However, it is understood that location indicator assembly 104 can be used in conjunction with other types of flotation devices, either wearable or non-wearable, without departing from the objectives and scope of the present invention.

Moreover, location indicator assembly 104 can be used in conjunction with other than flotation devices used in water environments. For example, location indicator assembly 104 is also adapted for use in conjunction with clothing garments, such as vests and jackets, for use in environments other than water environment, such as amusement parks, to provide high visibility for users wearing such garments. For example, such garments equipped with location indicator assembly 104 are suitable for use by children of small age, elderly individuals suffering from dementia, and individuals with special needs who are at high risk of getting lost in crowded environments, such as amusement parks. The deployment of indicator 106 provides high visibility, allowing such individuals to be readily identified and located in case they are lost in a crowd. It also allows such individuals to be easily identified, followed and tracked while walking in crowded environments, even if they are not lost.

Reference in the specification to "one embodiment" or "an embodiment" of the present invention, as well as other variations thereof, means that a particular feature, structure, characteristic, and so forth described in connection with the embodiment is included in at least one embodiment of the present invention. Thus, the appearances of the phrase "in one embodiment" or "in an embodiment", as well any other variations, appearing in various places throughout the specification are not necessarily all referring to the same embodiment. However, it is to be appreciated that features of one or more embodiments can be combined given the teachings of the present invention provided herein.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This may be extended for as many items listed.

The foregoing is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the present invention and that those skilled in the art may implement various modifications without departing from the scope and spirit of the invention. Those skilled in the art could implement various other feature combinations without departing from the scope and spirit of the invention. Having thus described aspects of the invention, with the details and particularity required by the patent laws, what is claimed and desired protected by Letters Patent is set forth in the appended claims.

What is claimed is:

1. A location indicator assembly comprising:

a support mechanism for undergoing movement between a retracted position and a deployed position;

a housing structure on which the support mechanism is mounted for undergoing movement between the retracted and deployed positions, the housing structure having guide slot, an anchor pin, a base pin, and a pivot pin;

an indicator device mounted to the support mechanism; and means for deploying and retracting the support mechanism to place the indicator device between deployed and retracted states, respectively;

wherein the support mechanism comprises a plurality of links including a pair of upper links to which the indicator device is connected and a pair of lower links, one of the lower links being connected to the base pin of the housing structure for undergoing pivotal movement relative thereto, and the other of the lower links having a sliding pin for undergoing sliding movement within the guide slot of the housing structure.

2. The location indicator assembly of claim 1, wherein the support mechanism comprises a scissor link mechanism.

3. The location indicator assembly of claim 1, wherein the indicator device comprises a pendant or flag.

4. The location indicator assembly of claim 1, wherein the means for deploying and retracting the support mechanism comprises:

a latch member mounted to the pivot pin of the housing structure for undergoing movement between an unpivoted position and a pivoted position to latch and unlatch the sliding pin;

a first biasing member for biasing the latch member to the unpivoted position;

a deployment cable assembly connected to the latch member for applying a pulling force to pivot the latch member to the pivoted position against a biasing force of the first biasing member;

a second biasing member interconnecting the sliding pin to the anchor pin of the housing structure; and a retraction cable assembly connected to the sliding pin for applying a pulling force to slide the sliding pin along the guide slot of the housing structure against a biasing force of the second biasing member.

5. The location indicator assembly of claim 4, wherein in the retracted position of the support mechanism in which the indicator device is in a retracted state, the sliding pin is retained by the latch member against the bias of the second biasing member; and wherein upon application of a pulling force by the deployment cable assembly, the latch member is pivoted about the pivot pin and against the biasing force of the first biasing member to unlatch the sliding pin so that sliding pin is permitted to undergo sliding movement along the guide slot to cause the support mechanism to undergo movement to the achieve the deployed position in which the indicator device is in the deployed state.

6. The location indicator assembly of claim 5, wherein in the deployed state of the indicator device, upon application of a pulling force by the retraction cable assembly, the sliding pin is caused to slide towards the latch member against the biasing force of the second biasing member until the sliding pin is latched by the latch member to place the support mechanism in the retracted position in which the indicator device is in the retracted state.

7. The location indicator assembly of claim 4, wherein the support structure and the latch member are mounted on opposite main surfaces of the housing structure.

8. The location indicator assembly of claim 4, further comprising a first pull handle attached to the deployment cable assembly to facilitate application of the pulling force by the deployment cable assembly, and a second pull handle attached to the retraction cable assembly to facilitate application of the pulling force by the retraction cable assembly.

9. In combination:

a flotation device; and a location indicator assembly according to claim 1 mounted to the flotation device.

10. The combination of claim 9, wherein the flotation device comprises a life jacket.

11. The combination of claim 10, wherein the life jacket is in the form of a vest and the location indicator assembly is mounted to a rear surface of the vest.

12. The combination of claim 10, wherein the life jacket is in the form of a vest, and the location indicator assembly is mounted on an exterior surface of the vest.

13. A life jacket comprising:

a vest; and a location indicator assembly mounted on the vest, the location indicator assembly comprising:

a housing structure having a guide slot, an anchor pin, a base pin, and a pivot pin;

an indicator device support mechanism mounted to the housing structure for undergoing movement between retracted and deployed positions, the support mechanism having a pair of upper links to which the indicator device is connected and a pair of lower links, one of the lower links being connected to the base pin of the housing structure for undergoing pivotal movement relative thereto, and the other of the lower links having a sliding pin for undergoing sliding movement within the guide slot of the housing structure;

a latch member mounted to the pivot pin of the housing structure for undergoing movement between an unpivoted position and a pivoted position to latch and unlatch the sliding pin;

a first biasing member for biasing the latch member to the unpivoted position;

a deployment cable assembly connected to the latch member for applying a pulling force to pivot the latch member to the pivoted position against a biasing force of the first biasing member;

a second biasing member interconnecting the sliding pin to the anchor pin of the housing structure; and a retraction cable assembly connected to the sliding pin for applying a pulling force to slide the sliding pin along the guide slot of the housing structure against a biasing force of the second biasing member.

14. The life jacket of claim 13, wherein in the retracted position of the support mechanism in which the indicator device is in a retracted state, the sliding pin is retained by the latch member against the bias of the second biasing member, and upon application of a pulling force by the deployment cable assembly, the latch member is pivoted about the pivot pin and against the biasing force of the first biasing member to unlatch the sliding pin so that sliding pin is permitted to undergo sliding movement along the guide slot to cause the support mechanism to undergo movement to the achieve the deployed position in which the indicator device is in the deployed state; and wherein in the deployed state of the indicator device, upon application of a pulling force by the retraction cable assembly, the sliding pin is caused to slide towards the latch member against the biasing force of the second biasing member until the sliding pin is latched by the latch member to place the support mechanism in the retracted position in which the indicator device is in the retracted state.

15. The life jacket of claim 13, further comprising a first pull handle attached to the deployment cable assembly for facilitating application of the pulling force by the deployment cable assembly, and a second pull handle attached to the retraction cable assembly for facilitating application of the pulling force by the retraction cable assembly.

16. The life jacket of claim 15, wherein the first and second pull handles are mounted to the vest so as to be positioned in a waist region of the vest.

17. The life jacket of claim 15, wherein the first and second pull handles are mounted to the vest so as to be positioned in a neck and/or chest region of the vest.

* * * * *